US005829267A

United States Patent [19]

Fromm et al.

[11] Patent Number: 5,829,267

[45] Date of Patent: Nov. 3, 1998

[54] FRESH AIR INLET AND DAMPER

[75] Inventors: Dale E. Fromm, Onalaska; Walter Earhart, Jr., La Crosse; William A. Smiley III, La Crosse; Dennis R. Dorman, La Crosse, all of Wis.

[73] Assignee: American Standard Inc., Piscataway, N.J.

[21] Appl. No.: 870,314

[22] Filed: Jun. 5, 1997

[51] Int. Cl.[6] ..... F25D 17/04; F24F 13/06

[52] U.S. Cl. ..... 62/404; 454/276

[58] Field of Search ..... 62/404, 407, 408, 62/409, 410, 411, 412, 427; 454/234, 236, 261, 265, 266, 275, 276, 337, 904

[56] References Cited

U.S. PATENT DOCUMENTS

| | | | |
|---|---|---|---|
| 2,470,201 | 5/1949 | Werner | 454/275 |
| 2,909,043 | 10/1959 | Baker et al. | 62/410 |
| 3,287,870 | 11/1966 | Johnson | 52/473 |
| 3,413,905 | 12/1968 | Johnson | 454/275 |

FOREIGN PATENT DOCUMENTS

| | | | |
|---|---|---|---|
| 57-357062338 | 4/1982 | Japan | 454/276 |
| 57-362268938 | 11/1987 | Japan | 454/275 |
| 404020729 | 1/1992 | Japan | 454/904 |

*Primary Examiner*—William Doerrler
*Attorney, Agent, or Firm*—William J. Beres; William O'Driscoll; Peter D. Ferguson

[57] ABSTRACT

An air inlet and damper arrangement. The arrangement comprises a system housing with an external wall having a fresh air inlet; and an inlet air enclosure located within the system housing adjacent the external wall and arranged about the air inlet. The enclosure has an aperture connecting the interior of the enclosure with the interior of the system housing; and a damper sized to cover the aperture and pivotable within the small enclosure between a position covering the aperture and a position uncovering the aperture.

25 Claims, 3 Drawing Sheets

FRESH AIR INLET AND DAMPER

BACKGROUND OF THE INVENTION

The present invention is directed to the fresh air inlet and damper of an air conditioning system, particularly that of a unit ventilator type air conditioning system.

Air conditioning systems mix return air from a space being conditioned with fresh air from the outside, condition the temperature and humidity of that mixed air, and provide the conditioned air to the space.

The fresh air inlet, and the damper controlling the volume of fresh air through the fresh air inlet, have been problematic in previous systems. Moisture from rain or snow has easily entered the unit and caused subsequent deterioration or corrosion on the evaporator coils and in other parts of the unit's interior. Additionally, a power failure or physical damage to the damper actuator in previous systems has resulted in the damper failing in an open position. This results in the uncontrolled entry of fresh air into the system. Uncontrolled entry of fresh outside air can be both unsafe and inefficient, particularly when the outside air temperatures are either extremely cold or extremely hot.

Previous systems have the further disadvantage that the damper blade provides non-linear airflow as the damper blade opens. This is due to the airflow being a function of the distance between the end of the damper blade and the bottom of the air conditioning system housing rather than a function of the damper opening. This results in the loss of temperature control to the conditioned space.

SUMMARY OF THE INVENTION

It is an object, feature and advantage of the present invention to solve the problems in the prior art systems.

It is an object, feature and advantage of the present invention to provide a damper which fails in the closed position.

It is a further object, feature and advantage of the present invention to provide a damper which positively and sealingly engages around the inlet air aperture upon such failure.

It is an object, feature and advantage of the present invention to control the airflow through a fresh air opening in a linear manner.

It is an object, feature and advantage of the present invention to eliminate the entry of moisture such as rain or snow through the fresh air opening of an air conditioning system.

It is a further object, feature and advantage of the present invention to divert moisture on the outside of the housing of an air conditioning system away from the fresh air entry.

It is an object, feature and advantage of the present invention to provide a mechanism which avoids the picking up of condensate by entering fresh air.

It is an object, feature and advantage of the present invention to provide a damper blade within a housing where the damper blade does not project outside of the housing.

It is an object, feature and advantage of the present invention to provide a buffer region in the outside air inlet of an air conditioning system.

It is a further object, feature and advantage of the present invention that the buffer region promote the separation of moisture from air entering the air conditioning system preferably by using gravity and a barrier wall to impede that moisture.

The present invention provides a moisture control arrangement for an air conditioning system comprising: an air conditioning system having a housing girding an interior containing air conditioning system components; an air inlet in the housing; and a buffer between the interior and the inlet. The buffer includes a moisture barrier wall between the interior and the inlet, and includes an air dam between the moisture barrier wall and the inlet. The buffer also includes an enclosure forming a space between the interior and the inlet, with the moisture barrier wall forming a part of the enclosure. The enclosure includes an aperture in the enclosure between the space and the interior, and the buffer includes a damper within the space and operable to control airflow through the aperture, wherein the aperture is located above the moisture barrier wall in the enclosure. The damper has a pivot point located within the space and above the aperture, the enclosure has a base, and the damper has a terminal end distal from the damper pivot point, such that the terminal end is always closer to at least one point in the aperture than to the base.

The present invention also provides an air inlet and damper. The air inlet and damper comprises a system housing with an external wall, and an inlet air enclosure located within the system housing adjacent the external wall and arranged about the air inlet. The external wall has a fresh air inlet. The enclosure has an aperture connecting the interior of the enclosure with the interior of the system housing. A damper is sized to cover the aperture and is pivotable within the small enclosure between a position covering the aperture and a position uncovering the aperture.

The present invention further provides an air inlet system. The system comprises an enclosure having a base, an exterior wall and an interior wall. The base is located between and connecting the interior and the exterior walls. The system includes an air inlet in the exterior wall; and an aperture in the interior wall. The aperture has a bottom located a first distance above the base. A damper blade is located within the enclosure and is pivotable to cover the aperture. The damper has a terminal end arranged such that the terminal end is always closer to the bottom of the aperture than to any point on the base.

The present invention still further provides an air inlet for an air conditioning system. The air inlet comprises a housing arranged about the air conditioning system; and an enclosure within the housing. The enclosure has a base and an aperture open to the interior of the housing and an inlet open to the exterior of the housing. A damper is located entirely within the enclosure and has a terminal end whereby the height of the enclosure is such that the distance from the terminal end to the aperture is always greater than the distance from the terminal end to the base of the enclosure.

The present invention still further provides a method of controlling airflow comprising the steps of: arranging a damper about an air inlet in a housing such that a terminal end of the damper is always closer to a bottom edge of the air inlet than to a base of the housing; and pivoting the damper about a proximal end of the damper so that the terminal end moves to and from the air inlet.

DETAILED DESCRIPTION OF THE DRAWINGS

Figure 1:
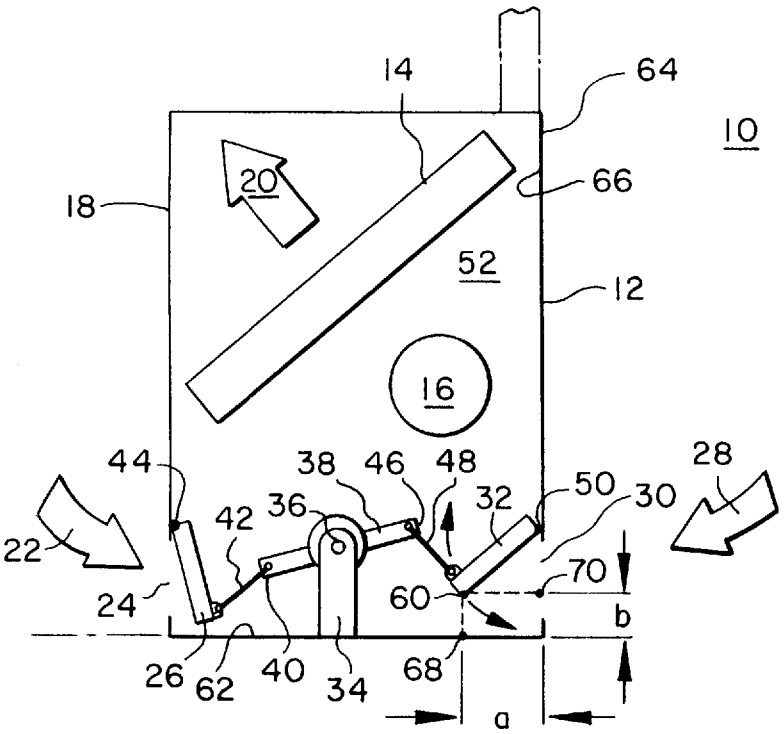
FIG. 1 (PRIOR ART)
FIG. 1 is a block diagram of a side view of a prior art fresh air inlet damper for a unit ventilator air conditioning system.

FIG. 1 shows a prior art fresh air inlet damper in an air conditioning system such as a unit ventilator. In particular, the system 10 includes a housing 12. The housing 12 encloses a coil 14 and a fan 16 which is used to cause air to flow over the coil 14 and out into a space 18 whose air is to be conditioned. Arrow 20 shows the direction of air flowing over the coil 14. The air being blown over the coil 14 is a combination of return air 22 entering the housing 12 from the space 18 through a return air inlet 24 as controlled by a return air damper 26, and fresh air 28 entering the housing 12 through a fresh air inlet 30 as controlled by a fresh air inlet damper 32. Typically, a single motor 34 controls the positions of both the return air damper 26 and the fresh air damper 32. The motor 34 turns a shaft 36 upon which a swing arm 38 is mounted. One end 40 of the swing arm 38 is connected by a linkage 42 to the return air damper 26. The return air damper 26 pivots about a pivot point 44 to open and close in response to the motor 34 turning the swing arm 38. The other end 46 of the swing arm 38 is connected by a linkage 48 to the fresh air damper 32. The fresh air damper 32 pivots about a pivot point 50 in response to the movement of the swing arm 38 by the motor 34.

In the prior art system 10, the fresh air damper 32 is open to the interior 52 of the housing 12, and the fresh air damper 32 opens toward the same direction that the outside air 28 is flowing. Thus, wind blown moisture in the form of rain or snow can be blown directly into the interior 52 of the housing 12. Such moisture can have adverse long-term effects on the coil 14, the fan 16, and the motor 34 in the form of corrosion, rust, blockages, mold or general deterioration.

Moreover, the terminal end 60 of the fresh air damper 32 is always closer to the housing base 62 than to the plane 64 of the fresh air inlet 30 in the exterior housing wall 66. More specifically, the distance between the terminal end 60 and a point 68 directly below that terminal end 60 is equal to a distance B, and the distance between the terminal end 60 and a point 70 in the plane 64 directly horizontal from the terminal end 60 is equal to a distance A. In the prior art system 10 of FIG. 1, the magnitude of the distance A will always be greater than the magnitude of the distance B, no matter what the position of the damper 32 is in. Effectively this means that fresh airflow 28 through the inlet 30 will be controlled by the distance B between the terminal end 60 and the base 62 rather than by the distance A between the terminal end 60 and the plane 64.

The present invention corrects this by enclosing the fresh air damper within a housing internal to the system housing, and by modifying the arrangement of the damper itself.

Figure 2:
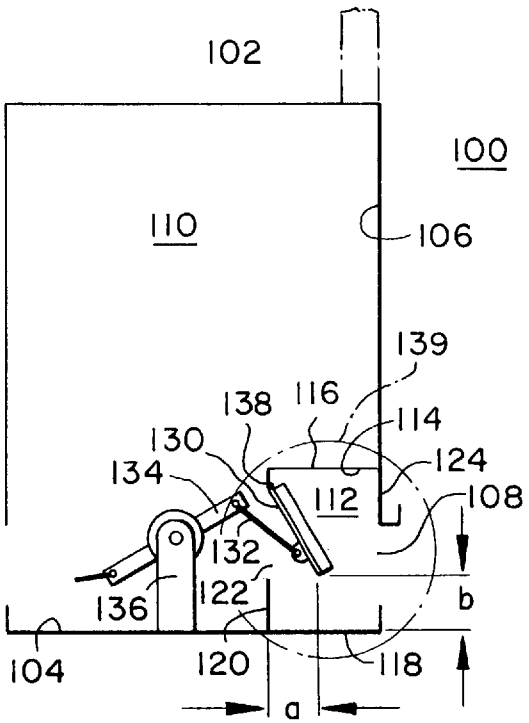
FIG. 2 shows the fresh air inlet and damper of the present invention as a block diagram in a unit ventilator air conditioning system.

This is shown in FIG. 2 where the present invention is shown as applied to an air conditioning system 100. For the sake of simplicity, the elements of a conventional air conditioning system are not shown and only the parts of the present invention relevant to the present invention are shown.

The present invention is located within a system housing 102 including a base 104 and an exterior wall 106. A fresh air inlet 108 is provided in the exterior wall 106 but this inlet 108 does not provide direct access to the interior 110 of the housing 102. Rather, the inlet 108 provides access to a space 112 enclosed by a fresh air housing 114, the space 112 acting as a buffer region between the interior 110 and the atmosphere. The fresh air housing 114 includes a top 116, base 118, an interior wall 120 having a fresh air aperture 122, and an exterior wall 124 planar with the system exterior wall 106 and arranged about the fresh air inlet 108.

Figure 4:
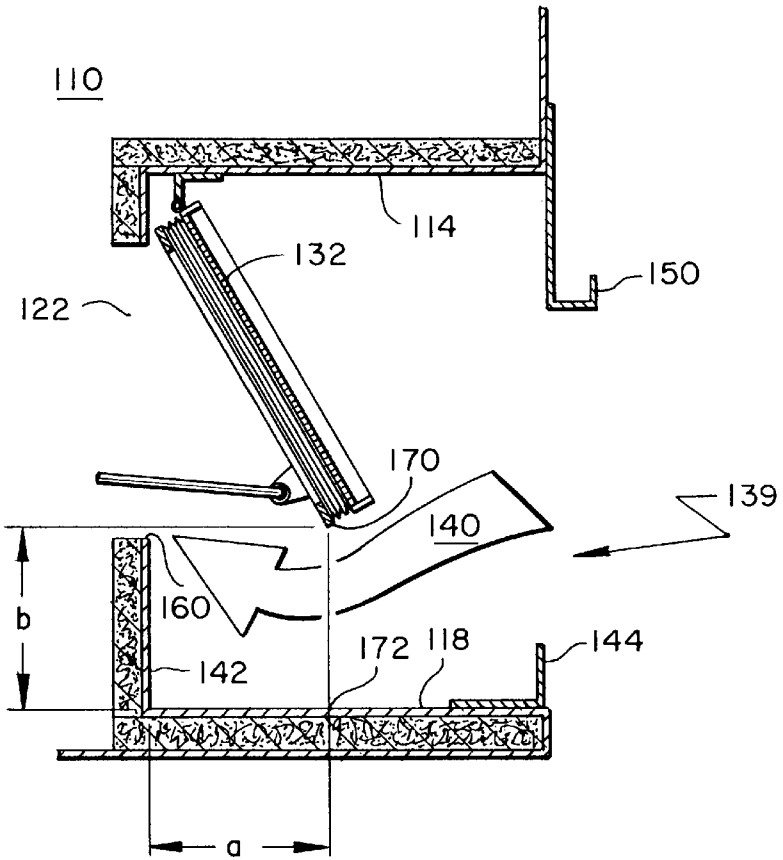
FIG. 4 shows an enlarged portion of FIG. 2 with the fresh air damper in a partially open position.
Figure 3:
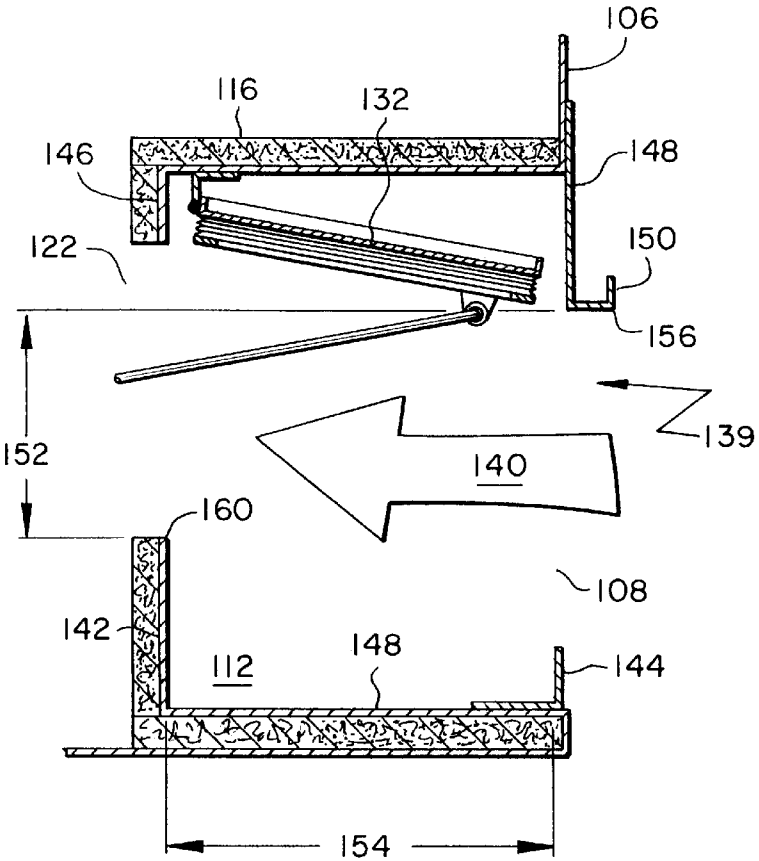
FIG. 3 shows an enlarged portion of FIG. 2 with the fresh air damper in the fully open position.
Figure 5:
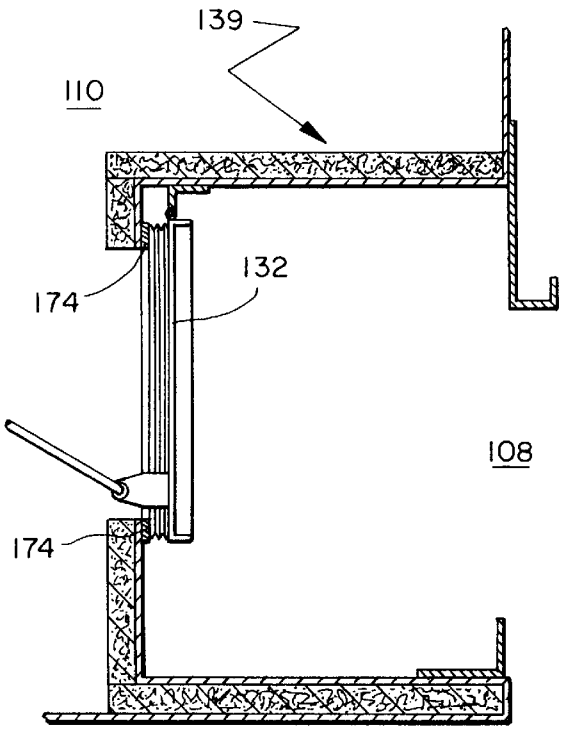
FIG. 5 shows an enlarged portion of FIG. 2 with the fresh air damper in the closed position.

A fresh air damper 130 is located in the space 112 and is controlled by a linkage 132 to a swing arm 134 and a motor 136 much like that of the prior art. However, the fresh air damper 130 has a pivot axis 138 adjacent the interior wall 120 and located above the fresh air aperture 122. FIGS. 3–5 show the fresh air enclosure 114 in more detail.

FIG. 3 shows a portion 139 of FIG. 3 including the fresh air damper 132 in a fully open position. The flow of fresh outside air is indicated by arrow 140. From FIG. 3, it can be seen that the fresh air inlet 108 is located in the exterior wall 124 lower than the location of the fresh air aperture 122 in the interior wall 120. The portion 142 of the interior wall 120 below the aperture 122 is of greater height than the height of the corresponding portion 144 of the exterior wall 124 located below the fresh air inlet 108. Similarly, the portion 146 of the interior wall 120 extending from the top 116 to the fresh air aperture 122 is smaller than the corresponding portion 148 of the exterior wall 124 extending between the top 116 and the fresh air inlet 108. Additionally, the portion 148 of the exterior wall 106, 124 has a gutter 150 projecting outwardly and arranged to divert liquid dripping down the exterior wall 106, 124 of the system 100. This is discussed in more detail subsequently with regard to FIGS. 6 and 7.

By comparing the downward extension of portion 148 with the upward extension of portion 142, it can be seen that there is only a horizontal gap 152 which has direct exposure in a horizontal direction to the entering outside air 140. Since the interior 112 has a depth 154 and since the outer extremity 156 of the gutter 150 projects outwardly, moisture in the form of rain or snow carried by the entering air 150 will drop below the upper end 160 of the portion 142 before that entering air 150 travels the distance 154. The portion 142 acts as a barrier wall to impede the entrance of moisture into the system 100. The combination of gravity, the depth 154, and the height of the portion 142 together with the overhanging gutter 150 acts as a moisture barrier to prevent the entrance of rain or snow into the interior 110 of the system 100. Furthermore, the portion 144 acts as an air dam to prevent and divert the entering air 140 from directly flowing along the base 118 and picking up any accumulated condensate by impinging on that condensate.

FIG. 4 shows the fresh air damper 132 in a partially opened position where the entering fresh air 140 passes below the terminal end 170 of the damper 132 and then up through the fresh air aperture 122. The fresh air housing 114 is sized so that the distance A between the terminal end 170 of the fresh air damper 132 and the fresh air aperture 122 (specifically, at the upper end 160 of the portion 142) will always be less than the distance B vertical drop between the terminal end 170 and a point 172 in the base 118 directly below the terminal end 170. Therefore and in contrast to the prior art shown in FIG. 1, the airflow will be controlled in proportion of the distance A from the terminal end 170 to the fresh air aperture 122 rather than by the distance B between the terminal end 170 and the base 118. In the invention, fresh airflow is controlled by distance A whereas in the prior art fresh airflow control is determined by distance B. In the prior art, distance A is always greater than distance B, whereas in the present invention distance B is always greater than distance A.

FIG. 5 shows the fresh air damper 132 in a fully closed position preventing the flow of air into the interior 110 of the system 100. The fresh air damper 132 preferably has a magnetic seal 174 about its periphery similar to that of a household refrigerator seal such that the entire aperture 122 is sealed from airflow when the damper 132 is in the closed position. Additionally, the loss of power will cause that fresh air damper 132 to close both by the force of gravity and by the force of any airflow through the inlet 108 and the aperture 122. Therefore a power loss or a linkage breakage result in the damper 132 defaulting to the closed position. Moreover, the magnetic seal 174 will act to close and seal the aperture 122, whether or not power is available.

Figure 6:
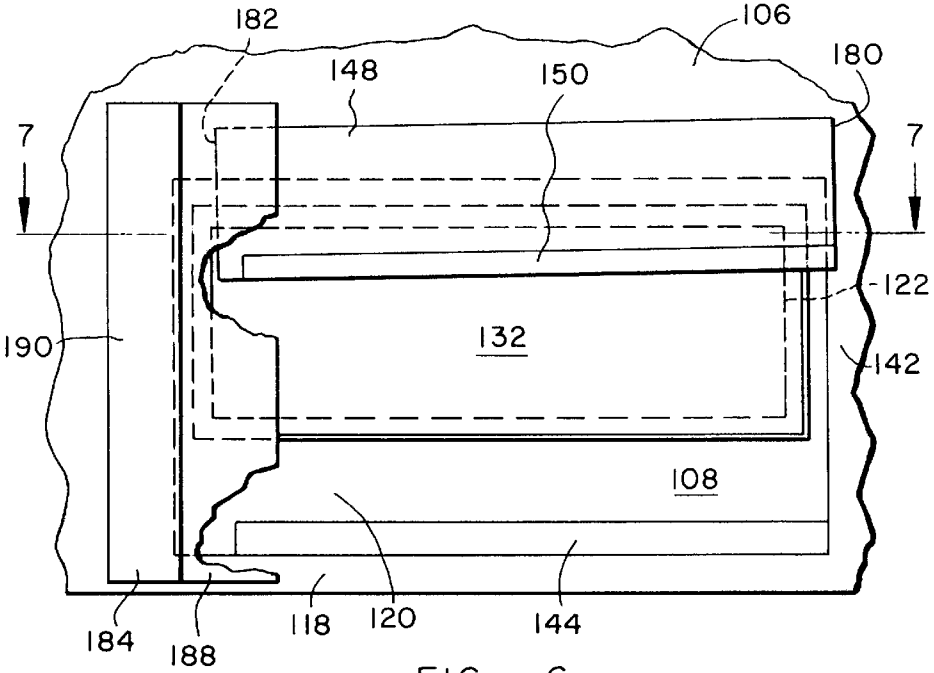
FIG. 6 shows a perspective front view of FIG. 3.

FIG. 6 shows a front view of FIG. 3 in perspective. This view includes the upper portion 148, the gutter 150, the lower portion 144, the fresh air inlet 108, the base 118 the lower portion 142 of the interior wall 120 and a portion of the fresh air aperture 122. The gutter 150 slopes downwardly from a first end 180 to a second end 182 so that any moisture running down the exterior wall 106 ultimately flows out the open end 182 of the gutter 150. Although not shown in FIGS. 2–5 for the sake of clarity, a downspout 184 including a portion 186 projecting perpendicularly from the exterior wall 124 and a portion 188 starting at a first distal end of portion 186 and running parallel to the exterior wall 106 is provided. The portions 186 and 188 enclose the second end 182 of the gutter 150 to shield moisture and, most particularly in case of the portion 188, to act as an air barrier and prevent that moisture from being blown into the interior 112 of the enclosure 114. The downspout 184 preferably has a portion 190 extending from a second end of the portion 186 and which is affixed to the exterior wall 148 in any conventional manner.

Figure 7:
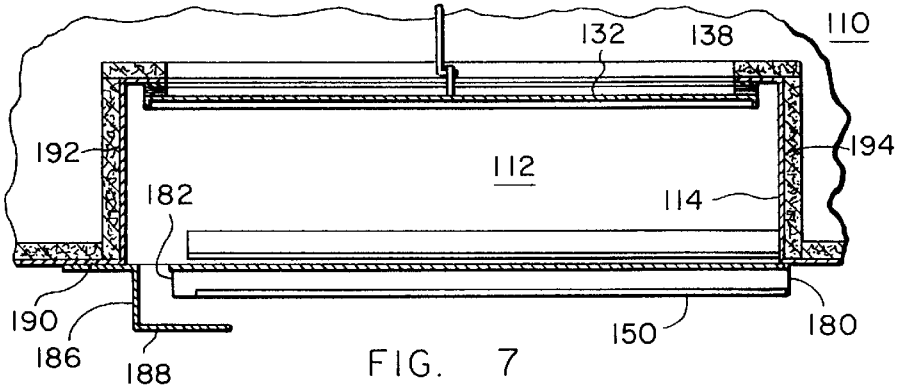
FIG. 7 shows a top view of FIG. 6 as a block diagram.

From the top view of the enclosure 114 shown in FIG. 7, it can be seen that side walls 192 and 194 are a part of the fresh air housing 114 and complete the enclosure of the interior 112 and the separation of that interior 112 from the interior 110 of the system 100.

What has been described is a fresh air inlet and damper which alleviates many of the problems of the prior art. It will be apparent to a person of ordinary skill in the art that many modifications and alterations are apparent. All such modifications and alterations are contemplated to fall within the spirit and scope of the claimed invention.

What is desired to be protected and claimed for Letters Patent of the United States is as follows:

1. A moisture control arrangement for an air conditioning system comprising:

an air conditioning system having a housing girding an interior containing air conditioning system components;

an air inlet in the housing;

an enclosure forming a space between the interior and the inlet, the enclosure including a base, a moisture barrier wall between the interior and the space, and an aperture in the moisture barrier wall and above the base.

2. The moisture control arrangement of claim 1 wherein the enclosure includes an air dam between the moisture barrier wall and the inlet.

3. The moisture control arrangement of claim 1 wherein the enclosure includes a damper within the space and operable to control airflow through the aperture.

4. The moisture control arrangement of claim 3 wherein the aperture is located above the moisture barrier wall in the enclosure.

5. The moisture control arrangement of claim 3 wherein the damper has a pivot point located within the space and above the aperture.

6. The moisture control arrangement of claim 5 wherein the damper has a terminal end distal from the damper pivot point, the enclosure being arranged so that the terminal end is always closer to at least one point in the aperture than to the base.

7. An air inlet and damper comprising:

a system housing with an external wall, the external wall having a fresh air inlet;

an inlet air enclosure located within the system housing adjacent the external wall and arranged about the air inlet, the enclosure having an aperture connecting the interior of the enclosure with the interior of the system housing;

a damper sized to cover the aperture and pivotable within the small enclosure between a position covering the aperture and a position uncovering the aperture wherein the damper has a pivot point located above and adjacent the aperture.

8. The air inlet and damper of claim 7 wherein the enclosure includes a floor and the damper includes a terminal end, the arrangement of the damper being such that the distance between the aperture and the terminal point is always greater than the distance between the terminal point and the floor for any damper position.

9. The system of claim 7 further including an air dam located at the bottom of the air inlet and extending substantially completely thereacross.

10. An air inlet and damper comprising:

a system housing with an external wall, the external wall having a fresh air inlet;

an inlet air enclosure located within the system housing adjacent the external wall and arranged about the air inlet, the enclosure having an aperture connecting the interior of the enclosure with the interior of the system housing;

a damper sized to cover the aperture and pivotable within the small enclosure between a position covering the aperture and a position uncovering the aperture; and a rain wall substantially extending across the top of the air inlet.

11. The system of claim 10 wherein the rain wall includes a drainage gutter.

12. The system of claim 11 wherein the rain wall includes a vertically extending downspout about a lower end of the drainage gutter and extending vertically from the lower end to below the air inlet, the downspout including a hood portion to block wind from draining condensate.

13. The air inlet and damper of claim 7 wherein the damper opens in an outward direction.

14. The air inlet and damper of claim 7 wherein the enclosure includes a floor and the damper includes a terminal end, the arrangement of the damper being such that the distance between the aperture and the terminal point is always greater than the distance between the terminal point and the floor for any damper position.

15. The system of claim 14 further including an air dam located at the bottom of the air inlet and extending substantially completely thereacross, a rain wall substantially extending across the top of the air inlet, and a drainage gutter forming a part of the rain wall.

16. An air inlet system comprising:

an enclosure having a base, an exterior wall and an interior wall, the base being located between and connecting the interior and the exterior walls;

an air inlet in the exterior wall;

an aperture in the interior wall, the aperture having a bottom located a first distance above the base; and a damper blade is completely located within the enclosure in any position and is pivotable to cover the aperture, the damper having a terminal end arranged such that the terminal end is always closer to the bottom of the aperture than to any point on the base.

17. The system of claim 16 wherein the damper blade is arranged with an axis above and adjacent the aperture such that the damper blade will pivot to a closed position by the force of wind or gravity in the event of a power failure.

18. The system of claim 16 wherein the inlet is located at a lower position in the exterior wall than the aperture is comparably located in the interior wall, and the base having a depth sized so that moisture in the airflow is directed, by gravity, at the interior wall below the aperture or at the base.

19. The system of claim 16 wherein the air inlet has a gutter externally located above it and sloped so as to act as a water dam and diverter.

20. The system of claim 19 including a downspout at the drainage end of the gutter whereby the downspout includes a hood portion extending below the air inlet and blocking airflow over moisture falling down the downspout.

21. The system of claim 16 wherein the base has a depth spaced so that the mass of a water drop in the entering airflow causes the drop to fall below the bottom of the aperture prior to traveling the depth's distance.

22. The system of claim 21 wherein the air inlet has an air dam located along its lower blank extending in a lateral direction.

23. An air inlet for an air conditioning system comprising:

a housing about the air conditioning system;

an enclosure within the housing, the enclosure having a base and an aperture open to the interior of the housing and an inlet open to the exterior of the housing; and a damper located entirely within the enclosure in any position and having a single terminal end whereby the height of the enclosure is such that the distance from the terminal end to the aperture is always greater than the distance from the terminal end to the base of the enclosure.

24. The system of claim 23 wherein the inlet includes a moisture barrier to prevent the direct impingement of entering airflow upon the base of the enclosure.

25. A method of controlling airflow comprising the steps of:

providing a damper having a proximal end and a terminal end;

arranging a damper about an air inlet in a housing such that the terminal end of the damper is always closer to a bottom edge of the air inlet than to a base of the housing; and pivoting the damper about the proximal end of the damper so that the terminal end moves to and from the air inlet.

* * * * *